US008083539B2

(12) United States Patent
Suzuki et al.

(10) Patent No.: US 8,083,539 B2
(45) Date of Patent: Dec. 27, 2011

(54) CONNECTOR

(75) Inventors: Sachio Suzuki, Hitachi (JP); Hideaki Takehara, Hitachi (JP); Kunihiro Fukuda, Tsukuba (JP); Yuta Kataoka, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 12/659,297

(22) Filed: Mar. 3, 2010

(65) Prior Publication Data

US 2011/0104929 A1 May 5, 2011

(30) Foreign Application Priority Data

Mar. 11, 2009 (JP) ..... 2009-058260

(51) Int. Cl.
*H01R 13/15* (2006.01)

(52) U.S. Cl. ..... 439/427; 439/264; 439/372

(58) Field of Classification Search ..... 439/263, 439/264, 427, 157, 372
See application file for complete search history.

(56) References Cited

U.S. PATENT DOCUMENTS

| | | | | |
|---|---|---|---|---|
| 4,560,222 | A * | 12/1985 | Dambach | 439/373 |
| 4,684,193 | A * | 8/1987 | Havel | 439/259 |
| 5,904,587 | A * | 5/1999 | Osypka et al. | 439/263 |
| 6,152,751 | A * | 11/2000 | Hanson et al. | 439/263 |
| 7,534,124 | B1 * | 5/2009 | Lemaire et al. | 439/263 |
| 7,575,465 | B2 * | 8/2009 | Hanks | 439/427 |
| 7,642,258 | B2 | 1/2010 | Chang et al. | |
| 2008/0132512 | A1 | 6/2008 | Chang et al. | |

FOREIGN PATENT DOCUMENTS

| | | |
|---|---|---|
| JP | 2008-103152 A | 5/2008 |
| JP | 2008-103153 A | 5/2008 |
| JP | 2008-123997 A | 5/2008 |

* cited by examiner

*Primary Examiner* — Hien Vu
(74) *Attorney, Agent, or Firm* — McGinn IP Law Group, PLLC

(57) ABSTRACT

A connector includes a female connector for accommodating a cylindrical and deformable female terminal provided at an end of a cable, a male connector for accommodating a male terminal configured to be inserted into the female terminal, a fastening member provided slidably around an outer periphery of the female terminal, and configured to tighten the female terminal to fasten the male terminal when inserted into the female terminal, and a slide mechanism for sliding the fastening member, which is provided in the female connector.

6 Claims, 7 Drawing Sheets

CONNECTOR

The present application is based on Japanese patent application No. 2009-058260 filed on Mar. 11, 2009, the entire contents of which are incorporated herein by reference.

BACKGROUND OF THE INVENTION

1. Field of the Invention

The present invention relates to a connector, more particularly, to a connector which is highly possible to be adopted in hybrid vehicles, electric vehicles, and the like.

2. The Related Art

Conventionally, as a conductor connection structure in a connector for electrically connecting cable (insulated cable) conductors together, there is known a terminal connection type structure which mates a male terminal provided at an end of one cable and a female terminal provided at an end of another cable, respectively, to thereby electrically connect their respective conductors to each other.

Also, as a conductor connection structure in a connector used in joints of large-capacity cables such as power cables (power electric cables), there is known a terminal connection type structure which mates a male pin terminal to a female socket terminal provided at ends of cables, respectively.

Refer to JP-A 2008-103152, JP-A 2008-103153, and JP-A 2008-123997, for example.

Also, using the cable connection portion in a vibrational environment, such as a hybrid vehicle, an electric vehicle, or the like, requires removal of the vibrational effect on the cable connection portion. To remove the problem of vibration, it has been suggested to provide a fastening member comprising a spring (ring spring) or the like at an outer periphery of a deformable female terminal to increase a force of pushing (i.e. pressure force) the female terminal against a male terminal by the fastening member, thereby firmly securing the female terminal and the male terminal to each other.

However, when the pressing force by the fastening member is increased, there is a disadvantage in that wear rate of contact portions between the conductors caused by insertion and removal of the terminal is accelerated.

SUMMARY OF THE INVENTION

Accordingly, it is an object of the present invention to provide a connector, which obviates the above problems, thereby suppressing the wear rate in the contact portions of the conductors caused by the insertion of the terminal, even when the pressing force of the fastening member is increased.

Further, it is another object of the present invention to provide a connector, which obviates the above problems, thereby suppressing the wear rate in the contact portions of the conductors caused by the removal of the terminal, even when the pressing force of the fastening member is increased.

(1) According to a feature of the invention, a connector comprises:

a female connector for accommodating a cylindrical and deformable female terminal provided at an end of a cable;

a male connector for accommodating a male terminal configured to be inserted into the female terminal;

a fastening member provided slidably around an outer periphery of the female terminal, and configured to tighten the female terminal to fasten the male terminal when inserted into the female terminal; and a slide mechanism for sliding the fastening member, which is provided in the female connector.

(2) In the connector, the slide mechanism may comprise a female inner housing for securing the fastening member in the female connector and a supporting member for slidably supporting the cable with respect to the fastening member, the male terminal may comprise a pressing part at a base part of the male terminal, and the pressing part is configured to abut and press a tip end of the female terminal to push the cable to slide backward with respect to the fastening member, to tighten the female terminal by the fastening member to fasten the male terminal. The pressing part may abut and press the tip end of the female terminal to push the cable to slide backward with respect to the fastening member, to tighten the female terminal by the fastening member to fasten the male terminal, when the male terminal is inserted into the female terminal.

(3) In the connector, the slide mechanism may further comprise an elastic member which biases the cable forward, and is configured to make the cable protrude forward with respect to the fastening member, to release fastening by the fastening member. The elastic member may bias the cable forward and make the cable protrude forward with respect to the fastening member, to release fastening by the fastening member, when the male terminal is detached from the female terminal.

(4) In the connector, the cable may comprise a stranded conductor comprising twisted plural wire conductors and an insulating layer formed around an outer periphery of the stranded conductor, and the female terminal may comprise a protruding portion formed by protruding the stranded conductor from the insulating layer at an end of the cable, the female terminal being formed in a cylindrical shape by widening a center of an end of the protruding portion to make the protruding portion hollow.

(5) In the connector, the female terminal may comprise a cylindrical portion cylindrically molded by diametrically widening the stranded conductor at the end of the protruding portion, and a tapered base which connects the cylindrical portion and a base part of the protruding portion, the tapered base being diametrically and gradually widened from the base part, in which the cylindrical portion is formed with plural slits in its axial direction, which circumferentially split the cylindrical portion.

(6) In the connector, the cylindrical portion of the female terminal may be formed to be widened toward its end.

(7) In the connector, an inner wall of the fastening member may be formed in a tapered shape, which is widened toward the end of the female terminal.

(8) In the connector, the male terminal member may comprise a pin terminal.

(9) In the connector, the male terminal may be integrally formed with a cable comprising a stranded conductor comprising twisted plural wire conductors and an insulating layer formed around the perimeter of the stranded conductor, in which the male terminal is formed by forming a protruding portion formed by protruding the stranded conductor from the insulating layer at the end of the cable, and diametrically compressing the end of the protruding portion.

POINTS OF THE INVENTION

According to the present invention, it is possible to provide a connector, by which the wear rate in the contact portions of the conductors caused by the insertion of the terminal is suppressed, even when the pressing force of the fastening member is increased.

Further, according to the present invention, it is possible to provide a connector, by which the wear rate in the contact portions of the conductors caused by the removal of the terminal is suppressed, even when the pressing force of the fastening member is increased.

BRIEF DESCRIPTION OF THE DRAWINGS

The preferred embodiments according to the invention will be explained below referring to the drawings, wherein:

FIGS. 1A and 1B are diagrams showing a connector in a first embodiment according to the invention, in which FIG. 1A is a cross-sectional view thereof, and FIG. 1B is a side view thereof;

FIGS. 2A and 2B are diagrams showing a female terminal cable used in the connector in the first embodiment, in which FIG. 2A is a front view thereof, and FIG. 2B is a side view thereof;

FIGS. 2C and 2D are diagrams showing a pin terminal used in the connector in the first embodiment, in which FIG. 2C is a side thereof, and FIG. 2D is a front view thereof;

FIGS. 4A and 4B are diagrams showing a pusher member used in producing the female terminal cable, in which FIG. 4B is a longitudinal sectional view thereof, and FIG. 4B is a cross sectional view thereof cut along 4B-4B line;

FIGS. 5A and 5B are explanatory diagrams for showing an operation of the connector of FIG. 1A, in which FIG. 5A is a cross-sectional view showing the connector before fastening, and FIG. 5B is a side view showing the connector before fastening;

FIGS. 6A and 6B are explanatory diagrams for showing an operation of the connector of FIG. 1A, in which FIG. 6A is a cross-sectional view showing the connector after fastening, and FIG. 6B is a side view showing the connector after fastening;

FIGS. 7A to 7C are diagrams showing a connector in a second embodiment according to the invention, in which FIG. 7A is a cross-sectional view thereof before mating, FIG. 7B is a cross-sectional view thereof before fastening, and FIG. 7C is a side view thereof after fastening;

FIGS. 10A and 10B are diagrams showing a male terminal cable used in the connector in the first and second embodiments, in which FIG. 10A is a side view thereof, and FIG. 10B is a front view thereof.

DETAILED DESCRIPTION OF THE PREFERRED EMBODIMENTS

Next, a connector in the embodiments according to the present invention will be explained below in more detail in conjunction with the appended drawings.

A connector of the invention is used in, for example, large-current wire harness connectors for use in the hybrid vehicles, the electric vehicles, and the like.

First Embodiment

Figure 1A:
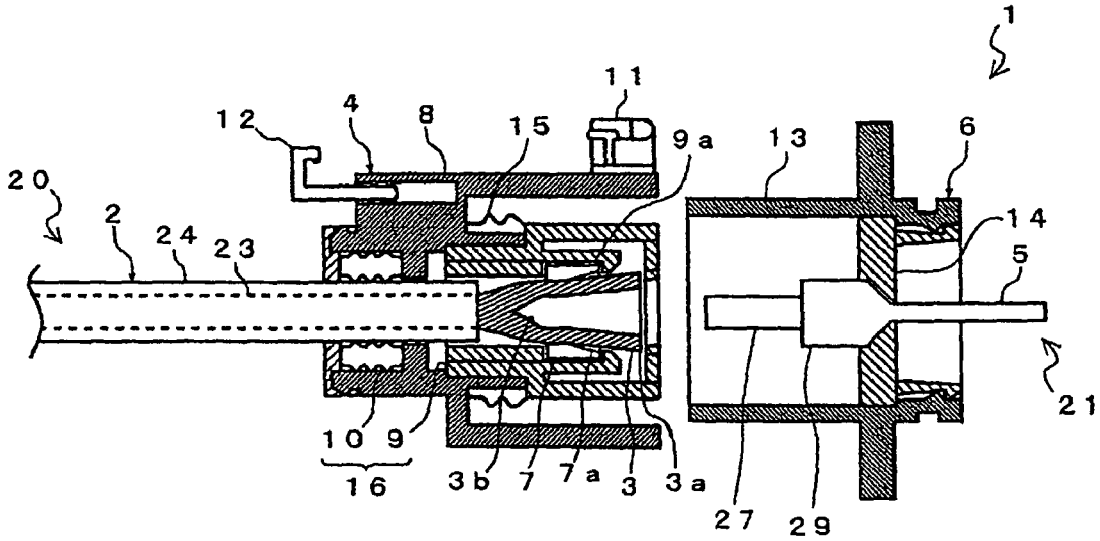
Figure 1B:
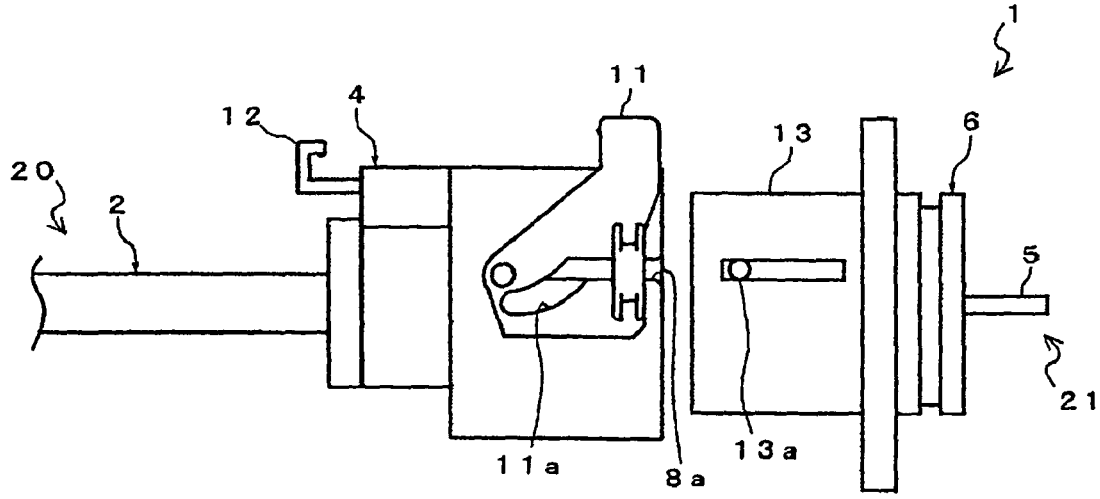

FIGS. 1A and 1B are diagrams showing a connector in a first embodiment according to the invention, in which FIG. 1A is a cross-sectional view thereof, and FIG. 1B is a side view thereof.

(Connector 1)

As shown in FIGS. 1A and 1B, a connector 1 comprises a female connector 4 for accommodating a cylindrical and deformable female terminal 3 provided at an end of a cable 2, and a male connector 5 for accommodating a male terminal configured to be inserted into the female terminal 3.

(Female Terminal Cable 20)

In the first embodiment, a female terminal cable 20 comprising the cable 2 and the female terminal 3 formed integrally with an end of the cable 2. A detailed configuration of the female terminal cable 20 will be explained later.

(Fastening Member 7)

A fastening member (spring) 7 is provided slidably around an outer periphery of the female terminal 3 of the female terminal cable 20. The fastening member 7 is provided for tightening the female terminal 3 by deforming to fasten the male terminal 5 when connecting the female terminal 3 and the male terminal 5, and is formed in an annular shape, or formed to have a C-shape in its transversal cross-section. This embodiment explains the use of an annular fastening member 7. An inner wall (inner peripheral surface) 7*a* of the annular fastening member 7 is formed in a tapered shape (flared shape), which is widened in diameter toward an end of the female terminal 3.

(Female Connector 4)

A female connector 4 comprises a female outer housing 8 for accommodating the end of the cable 2 of the female terminal cable 20 and the female terminal 3, a female inner housing for securing the fastening member 7 in the female outer housing 8, and a wire seal 10 as a supporting member for slidably supporting the cable 2 with respect to the fastening member 7, and a lever 11 rotatably provided to the female outer housing 8.

The female outer housing 8 comprises a metal such as aluminum or aluminum alloy, and the female inner housing 9 comprise an insulative material. The female inner housing 9 preferably comprises a material with high thermal conductivity for effectively dissipating a heat generated at a joint portion between the female terminal 3 and the male terminal 5. The heat generated at the joint portion between the female terminal 3 and the male terminal 5 is dissipated to the outside through the female terminal 3, the fastener member 7, the female inner housing 9, and the female outer housing 8.

The female inner housing 9 is provided with a fastening member-accommodating part 9*a* for accommodating the fastening member 7, and the fastening member 7 is secured to the female outer housing 8 via the female inner housing 9.

The female terminal cable 20 is slidably supported in a longitudinal direction of the female terminal cable 20 by the wire seal 10 provided at a rear end (left side in FIG. 1A) of the female outer housing 9 and the fastening member 7. The wire seal 10 also serves as a sealing member for sealing a gap between the cable 2 and the female outer housing 8.

(Slide Mechanism 16)

The female inner housing 9 and the wire seal 10 are included in a slide mechanism 16 of the present invention. Namely, the slide mechanism 16 comprises the female inner housing 9 and the wire seal 10 as a supporting member for slidably supporting the female terminal cable 20 with respect to the fastening member 7. More concretely, the female inner housing 9 secures the fastening member 7 to the female outer housing 8, supports a tip end (nose) of the female terminal cable 20 (the female terminal 3) via the fastening member 7, and slidably supports an end part side of the female terminal cable 20 by the wire seal 10, so as to slide the female terminal cable 20 backward and forward with respect to the fastening member 7 and slide the fastening member 7 along the female terminal 3.

In addition, the female outer housing 8 is provided with a guide groove 8*a* for guiding a projection 13*a* formed on a side surface of the male connector 6, when mating the female connector 4 and the male connector 6.

Figure 6A:
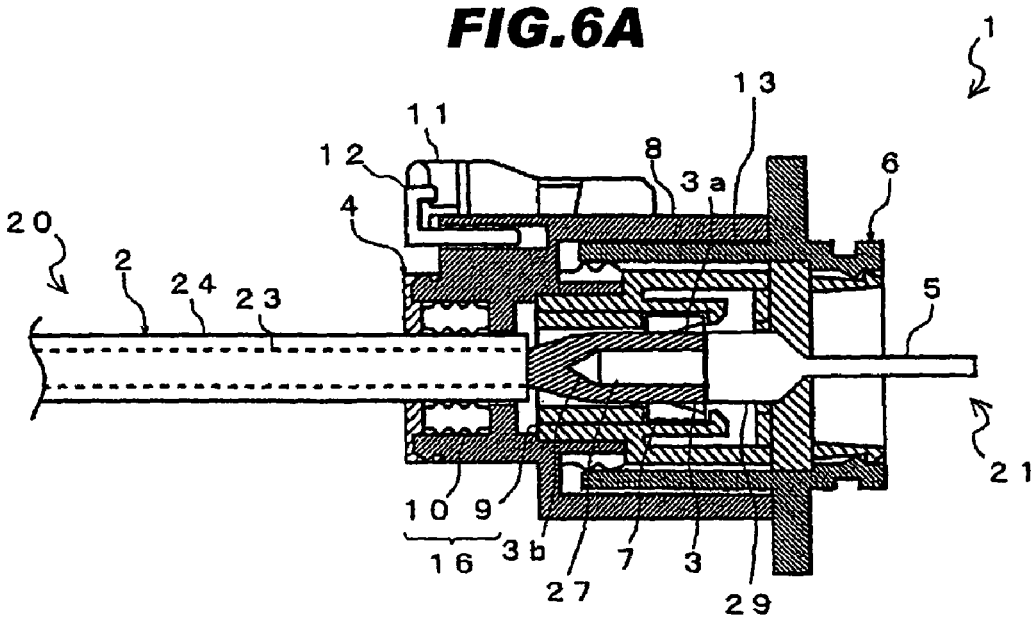
Figure 6B:
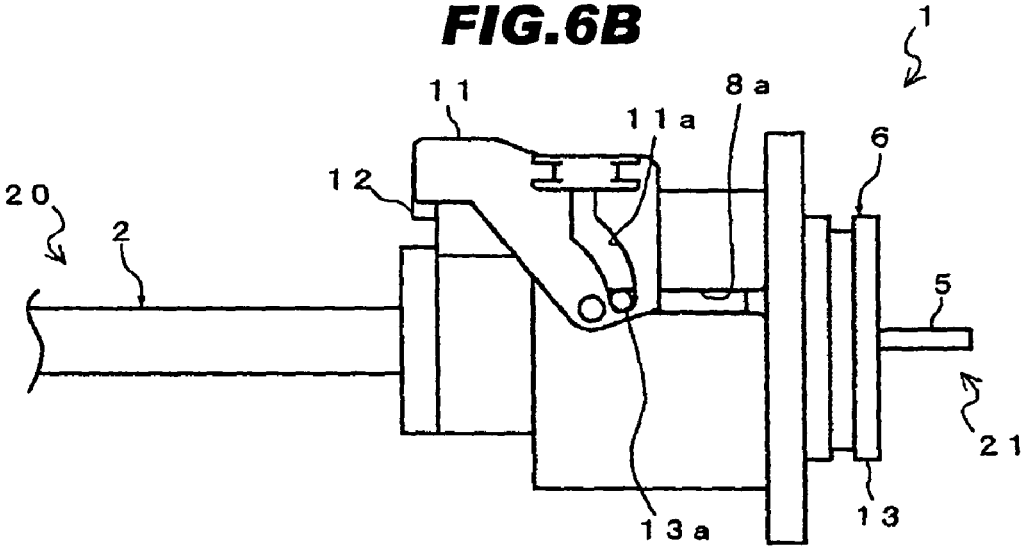

The lever 11 is provided with a projection-securing groove 11*a* for accommodating the projection 13*a* inserted to the guide groove 8*a* in a released position in which the lever 11 is rotated to a forward direction (i.e. right side in FIG. 1B), and securing the projection 13*a* accommodated in the projection-securing groove 11*a* between the guide groove 8*a* and the projection-securing groove 11*a* in a locked position in which the lever is rotated to a backward direction (i.e. left side in FIG. 1B) (cf. FIG. 6B).

Further, a CPA (Connector Position Assurance Member) 12 is provided at an upper portion of the female outer housing 8. The CPA locks the lever 11 when the lever 11 is rotated in the locked position, and detects a correct mating of the female connector 4 and the male connector 6.

(Male Connector 6)

The male connector 6 mainly comprises a male outer housing 13 for accommodating the male terminal 5, and a male inner housing 14 for securing the male terminal 5 in the male outer housing 13.

In this embodiment, a case of using a terminal pin 21 as the male terminal 5 is explained. The terminal pin 21 will be explained later in more detail.

The male outer housing 13 comprises a metal such as aluminum or aluminum alloy. The projection 13*a* to be inserted into the guide groove 8*a* of the female connector 4 is formed at a side surface of the male outer housing 13. The male inner housing 14 comprises an insulative material.

In addition, the female outer housing 8 of the female connector 4 is provided with a seal ring 15 for sealing a gap between the female outer housing 8 and the male outer housing 13 when mating the female connector 4 and the male connector 6.

The detailed structure of the male terminal cable 20 and the pin terminal 21 will be explained below.

(Female Terminal Cable 20)

Figure 2A:
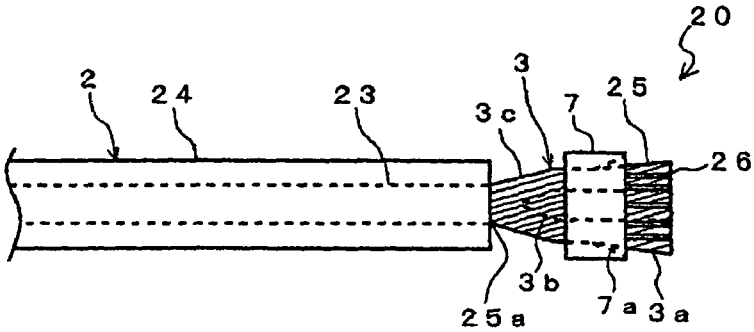
Figure 2B:
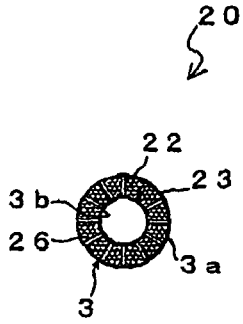

FIGS. 2A and 2B are diagrams showing a female terminal cable used in the connector in the first embodiment, in which FIG. 2A is a front view thereof, and FIG. 2B is a side view thereof.

Figure 2C:
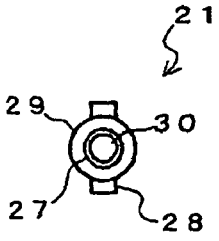
Figure 2D:
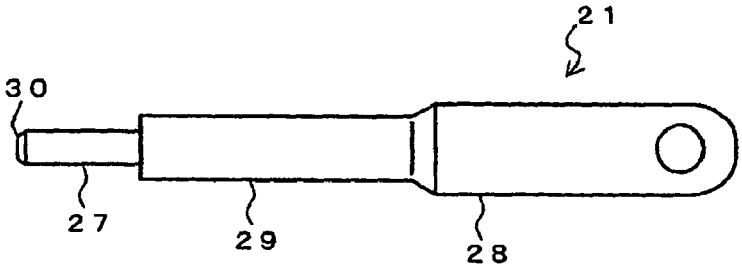

FIGS. 2C and 2D are diagrams showing a pin terminal used in the connector in the first embodiment, in which FIG. 2C is a side thereof, and FIG. 2D is a front view thereof.

As shown in FIGS. 2A and 2B, the cable 2 used for the female terminal cable 20 comprises a stranded conductor 23 comprising twisted plural wire conductors 22, and an insulating layer 24 formed around an outer periphery of the stranded conductor 23.

It is desirable that the stranded conductor 23 of the cable 2 uses twisted multiple wire conductors 22, i.e., at least twenty (20), preferably fifty (50) or more twisted wire conductors 22. The wire conductors 22 to be used may have an outer diameter of substantially 0.1 to 1.0 mm, for example. It is desirable that the stranded conductor 23 has an outer diameter of 4.0 to 10 mm, for example, and that the entire stranded conductor 23 is rigid.

The wire conductors 22 comprises copper, a copper alloy, aluminum, an aluminum alloy, or the like. The insulating layer 24 comprises a rubber material or a plastic material. Although the insulating layer 24 is formed by one layer in the first embodiment, it may have a multilayer structure.

(Female Terminal 3)

The female terminal 3 is formed by protruding the stranded conductor 23 at the end of the cable 2 from the insulating layer 24 to provide a protruding portion 25, then diametrically widening the protruding portion 25 from a center of an end of the protruding portion to provide a hollow cylindrical configuration.

More concretely, the female terminal 3 comprises a cylindrical portion 3*a* at the end of the protruding portion 25 cylindrically molded by diametrically widening a part of the protruding portion 25 at the tip end side, namely, the end of the protruding portion 25 of the stranded conductor 23, and a tapered base 3*c* provided between a base end 25*a* of the protruding portion 25 at a boundary between the protruding portion 25 and the insulating layer 24, and the cylindrical portion 3*a*. The tapered base 3*c* is diametrically and gradually widened from the base end 25*a*. At the end of the female terminal 3, a hollow portion 3*b* surrounded by the cylindrical portion 3*a* is formed. Further, the cylindrical portion 3*a* of the female terminal 3 is formed to be widened toward its end to provide a flared (tapered) configuration.

(Slits 26)

The cylindrical portion 3*a* of the female terminal 3 is formed with plural slits 26 in its axial direction, which circumferentially split the cylindrical portion 3*a*. It is preferred to form an even number of the slits 26 to circumferentially and equally split the cylindrical portion 3*a*. This allows the respective inner surfaces of the split cylindrical portions 3*a* to be located directly opposite each other with respect to the male terminal 5 (or the hollow portion 3*b*), and therefore the female terminal 3 and the male terminal 5 to firmly mate to each other. Also, the slits 26 are located directly opposite each other with respect to the male terminal 5 (or the hollow portion 3*b*), and can therefore inhibit the male terminal 5 from fitting into the slit 26 and deforming the female terminal 3.

(Detailed Structure of the Fastening Member 7)

The female terminal 3 is provided with the fastening member 7 slidably around the outer periphery of the female terminal 3. It is desirable that the fastening member 7 comprises a high-conductivity material (highly-conductive material). To prevent the fastening member 7 from hetero-metal contact corrosion, the fastening member 7 may comprises the same material as the material of the stranded conductor 23. For example, where the stranded conductor 23 comprises copper or a copper alloy, the fastening member 7 may comprises copper or a copper alloy. Where the stranded conductor 23 comprises aluminum or an aluminum alloy, the fastening member 7 may comprise aluminum or an aluminum alloy.

When the fastening member 7 is used in an environment of large amounts of heat generated, such as in large current cables, it is concerned that an elastic force of the fastening member 7 is weakened and a contact resistance is increased by stress relaxation due to the heat. Therefore, in the case of using, especially, a fastening member 7 with a C-shaped cross-section, it is preferred that the fastening member 7 uses an elastic iron-based alloy, such as stainless, from the point of view of long-term maintenance of its elasticity. In this manner, the material to be used for the fastening member 7 may be determined appropriately according to purposes of use, materials used as the stranded conductor 23, etc.

(Process for Fabricating the Female Terminal Cable 20)

Figure 3A:
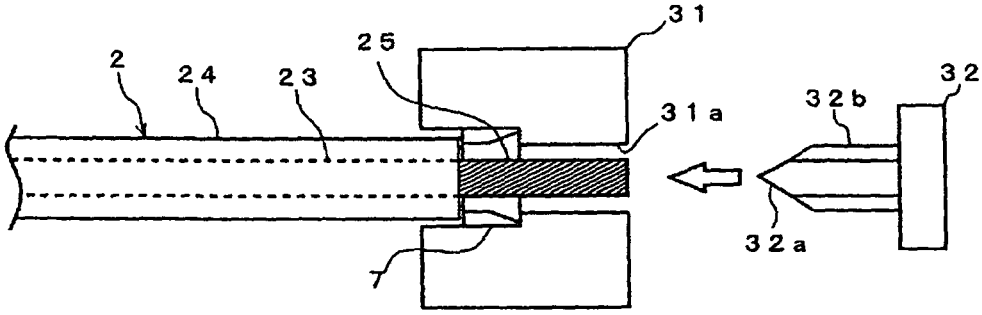
FIGS. 3A to 3C are diagrams showing a process for producing the female terminal cable of FIG. 2A.
Figure 3B:
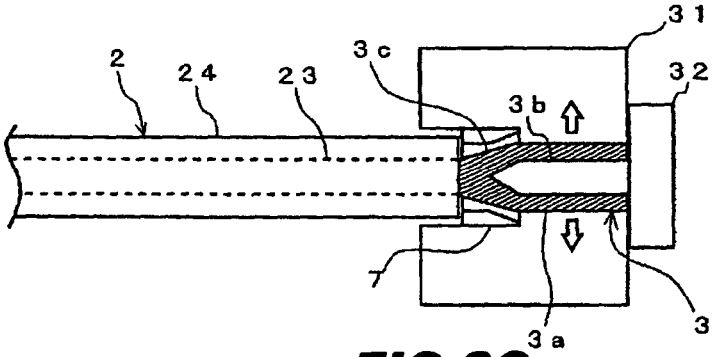
Figure 3C:
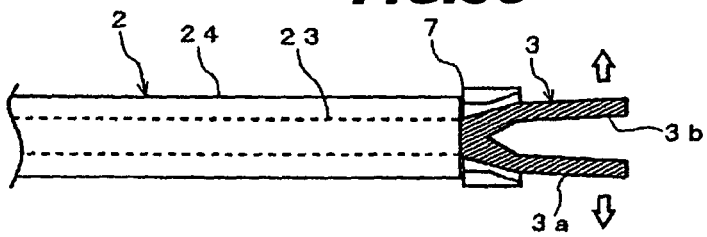

FIGS. 3A to 3C are diagrams showing a process for producing the female terminal cable of FIG. 2A.

The female terminal cable 20 is fabricated as follows.

As shown in FIG. 3A, the stranded conductor 23 at an end of cable 2 is firstly formed to protrude from the insulating layer 4 to provide the protruding portion 25. Around the protruding portion 25 is arranged a female terminal mold 31. In this case, it is preferred to provide the fastening member 7 around the protruding portion 25 prior to the arrangement of the protruding portion 25 in the female terminal mold 31. A length of the stranded conductor 23 protruding from the end of cable 2 (namely, a length of the protruding portion 25) is 15 to 20 mm, for example.

The female terminal mold 31 is formed with a female terminal mold hole 31A with a substantially constant inner diameter. The protruding portion 25 is arranged in the female terminal mold hole 31*a*.

Next, as shown in FIG. 3B, a pusher member 32 with a pointed protrusion 32*a* is pushed into the end of the protruding portion 25, to widen the center of the end of the protruding portion 25 to make the protruding portion 25 hollow, and a pressure is applied between the female terminal mold 31 and the pusher member 32 to mold the protruding portion 25, thereby providing the female terminal 3 including the hollow portion 3*b* in the protruding portion 25. The pointed protrusion 32*a* of the pusher member 32 is formed to be sized equal to or smaller than an outer diameter of a terminal part 27 of the pin terminal 21 (i.e., an outer diameter of a portion to be inserted into and mated to the hollow portion 3*b*).

Figure 4A:
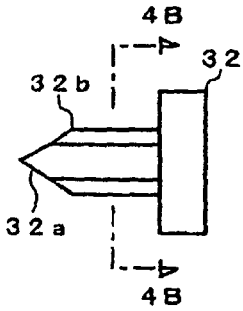
Figure 4B:
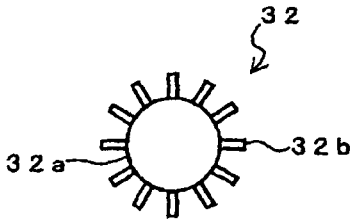

FIGS. 4A and 4B are diagrams showing the pusher member 32 used in producing the female terminal cable, in which FIG. 4B is a longitudinal sectional view thereof, and FIG. 4B is a cross sectional view thereof cut along 4B-4B line.

As shown in FIGS. 4A and 4B, an outer periphery of the pointed protrusion 32*a* of the pusher member 32 is axially formed with slit formation protrusions 32*b*. The slits 26 are formed simultaneously when the stranded conductor 23 is molded by pressure to form the female terminal 3. Although the stranded conductor 23 comprises the twisted plural wire conductors 2, because a protruding portion of the stranded conductor 23 is short and thus substantially straight, the slits 26 can be molded by inserting the pusher member 32 formed with the slit formation protrusions 22*b* into the protruding portion of the stranded conductor 23.

As shown in FIG. 3C, the female terminal mold 31 and the pusher member 32 are subsequently removed, to widen the end of the cylindrical portion 3*a* outward. According to this shaping, the slits 26 are widened, thereby forming the flared (tapered) cylindrical portion 3*a*. An outer diameter of the cylindrical portion 3*a* prior to the wide-end shaping is 10 mm, for example, and an inner diameter thereof is 5 mm, for example. A length (mating length) in the axial direction of the hollow portion 3*b* is 10 mm, for example.

In accordance with the process explained above, the female terminal cable 20 as shown in FIGS. 2A and 2B is fabricated. Although an example of widening the end of the cylindrical portion 3*a* outward after the pressure molding of the female terminal 3 has been explained here, the end of the cylindrical portion 3*a* may be widened during the pressure molding of the female terminal 3.

Also, a conductive metal may be adhered to the female terminal 3 to reinforce the mechanical strength of the female terminal 3. As the conductive metal to be adhered to the female terminal 3, there is nickel, a nickel alloy, silver, a silver alloy, tin, a tin alloy (e.g., solder), gold, a gold alloy, platinum, a platinum alloy, copper, a copper alloy, aluminum, an aluminum alloy, zinc, a zinc alloy, or the like.

When the conductive metal is adhered to the female terminal 3, the female terminal 3 is immersed in the conductive metal melt to be adhered the conductive metal, with the pusher member 32 pushed in the female terminal 3, after the pressure molding of the female terminal 3. This may be followed by widening the end of the cylindrical portion 3*a*. Although the case of adhering the conductive metal to the female terminal 3 after forming the female terminal 3 has been explained here, the conductive metal may first be adhered to the protruding portion 25 of the stranded conductor 23, and the female terminal 3 may then be formed by pressure molding.

As shown in FIGS. 2C and 2D, the pin terminal 21 comprises a terminal part 27 to mate to the female terminal 3 of the female terminal cable 20, and a terminal part 28 for an external electric equipment formed integrally with the terminal part 27 and to connect to the external electric equipment. A pressing part 29 provided with step portions is formed at a base part of the terminal part 27. The pressing part 29 is formed by diametrically widening the terminal part 27. An outer diameter of the pressing part 29 is formed to be larger than a diameter of the hollow part 3B at the end of the female terminal 3.

A tapered terminal tip end part 30 is formed at a tip end of the terminal part 27. The tapered terminal tip end part 30 is compressed toward the end of the terminal part 27, to facilitate the insertion of the pin terminal 21 into the female terminal 3. The pin terminal 21 comprises copper, a copper alloy, aluminum, or an aluminum alloy, for example.

(Mating Operation of the Female Connector 4 and the Male Connector 6)

Figure 5A:
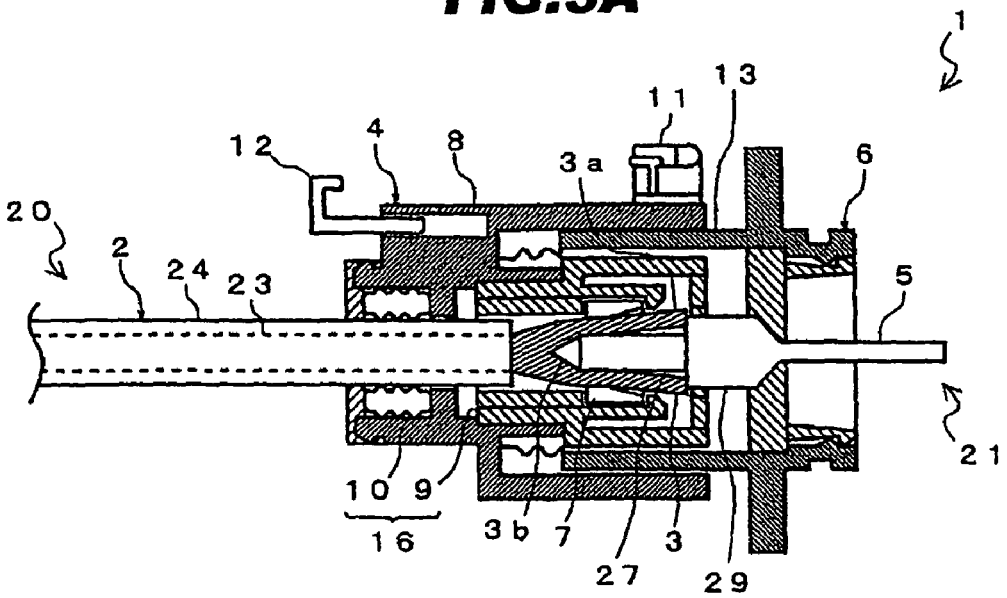
Figure 5B:
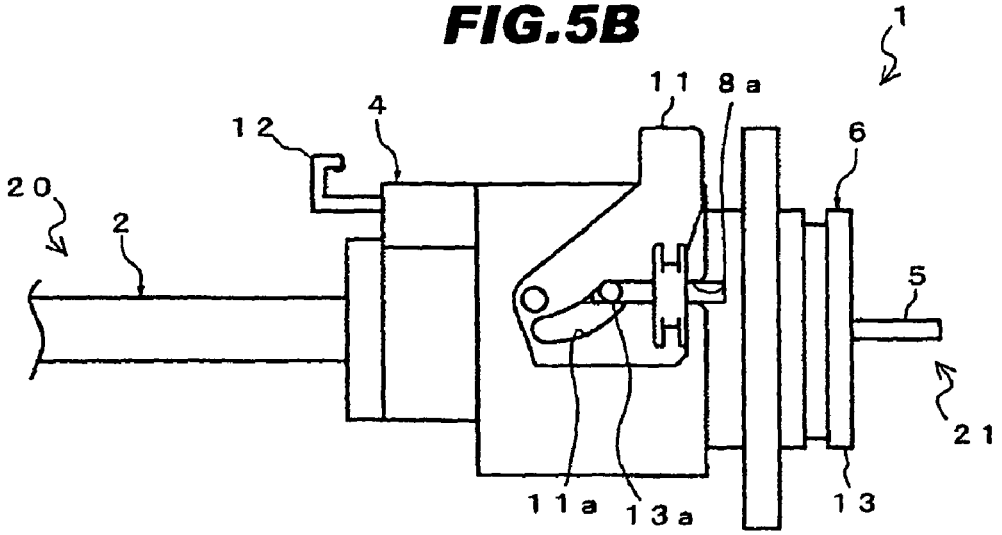

FIGS. 5A and 5B are explanatory diagrams for showing an operation of the connector 1 of FIG. 1A, in which FIG. 5A is a cross-sectional view showing the connector 1 before fastening, and FIG. 5B is a side view showing the connector 1 before fastening.

As shown in FIGS. 5A and 5B, for mating the female connector 4 and the male connector 6, the lever 11 is located in the released position, and the female terminal cable 20 is located in a position in which the end of the female terminal 3 is protruded forward with respect to the fastening member 7. Thereafter, the projection 13*a* of the male connector 6 is inserted along the guide groove 8*a*. As a result, the terminal part 27 of the pin terminal 21 is inserted into the female terminal 3, so that a tip end of the pressing part 29 of the pin terminal 21 abut a tip end of the female terminal 3. In the meantime, the projection 13*a* of the male connector 6 is accommodated in the projection-securing groove 11*a* of the lever 11.

At this time, the wide-ended shape of the cylindrical portion 3*a* of the female terminal 3 allows the terminal part 27 of the pin terminal 21 to be inserted into the hollow portion 3*b* easily and without wear in contact portion.

FIGS. 6A and 6B are explanatory diagrams for showing an operation of the connector 1 of FIG. 1A, in which FIG. 6A is a cross-sectional view showing the connector 1 after fastening, and FIG. 6B is a side view showing the connector 1 after fastening.

In this state, the lever 11 is rotated to the locked position. As shown in FIGS. 6A and 6B, the male connector 6 is pulled to a side close to the female terminal 4. The pressing part 29 presses the tip end of the female terminal 3 to push the female terminal cable 20 backward with respect to the fastening member 7, thereby sliding the female terminal cable 20. In other words, the pressing part 29 is configured to abut and press the tip end of the female terminal 3 to push the female terminal cable 20 to slide backward with respect to the fastening member 7, to tighten the female terminal 3 by the fastening member 7 to fasten the male terminal 5.

According to this operation, the fastening member 7 is subsequently slid forward toward the tip end of the female terminal 3. The slits 26 are then narrowed to diametrically compress the cylindrical portion 3*a* to fasten the terminal part 27 of the pin terminal 21 into the female terminal 3. As a result, the stranded conductor 23 of the female terminal cable 20 is electrically connected to the pin terminal 21.

A fastening strength is adjustable by adjusting the inner diameter (minimum inner diameter) of the fastening member 7 when using the annular fastening member 7, and by adjusting the inner diameter (minimum inner diameter) of the fastening member 7 or appropriately selecting a material for the fastening member 7 to adjust its elasticity when using the fastening member 7 with C-shaped cross-section.

(Functions and Advantages of the First Embodiment)

Functions and advantages of this embodiment are explained below.

In the connector 1 of this embodiment, the fastening member 7 for tightening the female terminal 3 when the male terminal 5 is inserted to the female terminal 3, to fasten the male terminal 5 is provided slidably around the outer periphery of the female terminal 3. Further, the slide mechanism 16 for sliding the fastening member 7 is provided in the female connector 4.

According to this structure, it is possible to fasten the male terminal 5 to the female terminal 3 by sliding the fastening member 7 after mating the female terminal 3 and the male terminal 5. Therefore, even though the pressing force of the fastening member 7 is increased, it is possible to suppress the wear in the contact portion caused by the insertion of the male terminal 5, and it is possible to securely fix the male terminal 5 into the female terminal 3.

This can realize the connector 1, a connection portion of which is not adversely affected by vibration, and a contact portion of which is not worn during the insertion of the male terminal 5. Thus, the connector is suitable for electric cables used in a vibrational environment, such as hybrid vehicles or electric vehicles.

In the connector 1, the female terminal cable 20 is used. In the female terminal cable 20, the stranded conductor 23 at the end of the cable 2 is formed to protrude from the insulating layer 24 to form the protruding portion 25, and the protruding portion 25 is widened at the center of its end to make the protruding portion 25 hollow, to provide the female terminal 3.

In the first embodiment, the stranded conductor 23 of the cable 2 is converted into the terminal to form the female terminal cable 20, so that the conventional terminal is no longer required. Since the conventional terminal is not provided, and the connection portion of the conductors (the connection portion of the female terminal 3 and the male terminal 5) can therefore be smaller than the outer diameter of the cable 2, thus ensuring the size reduction of the connector 1.

Since no conventional terminal is required, it can be ensured that the number of parts is reduced, thereby allowing a reduction in production cost. Further, reduction in the size and the number of parts can ensure the weight reduction of the connector 1.

Further, since no conventional terminal required, the increase of the connection resistance caused in the connection portion of the stranded conductor 23 and the terminal, and therefore heat generation in the connection portion can be inhibited.

Still further, since the cylindrical portion 3*a* of the female terminal 3 is formed to be widened toward its end in this embodiment, the wear in the contact portion caused by the insertion (or removal) of the male terminal 5 can be inhibited, and the male terminal 5 can easily be inserted into the hollow portion 3*b* of the female terminal 3.

Further, since the inner wall 7*a* of the fastening member 7 is formed in a tapered shape which is widened toward the end of the female terminal 3 in this embodiment, the fastening member 7 can easily be slid during fastening, and the cylindrical portion 3*a* can easily be diametrically compressed to fasten the male terminal 5 into the female terminal 3.

The other embodiments of the invention are described below.

Second Embodiment

Figure 7A:
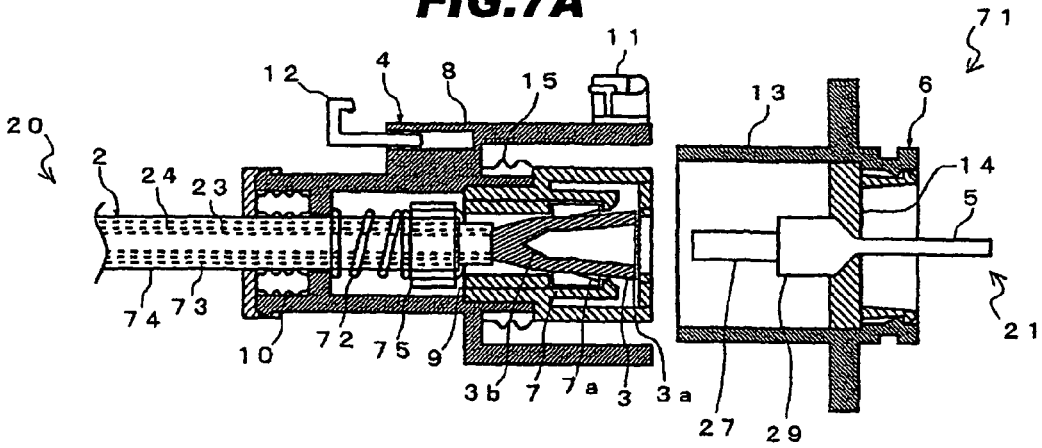
Figure 7B:
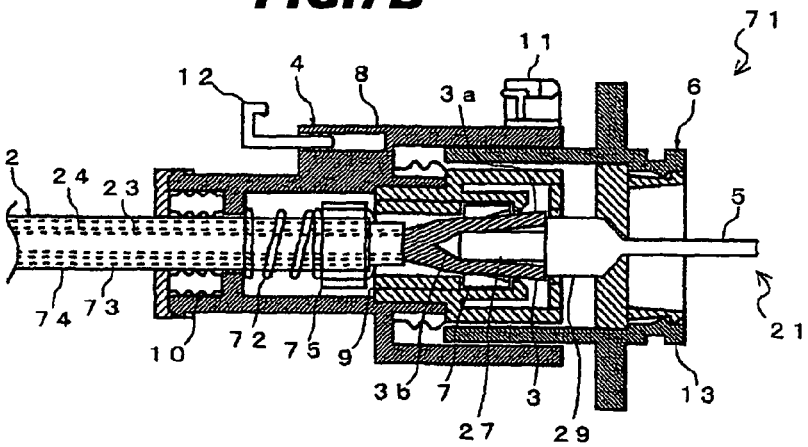
Figure 7C:
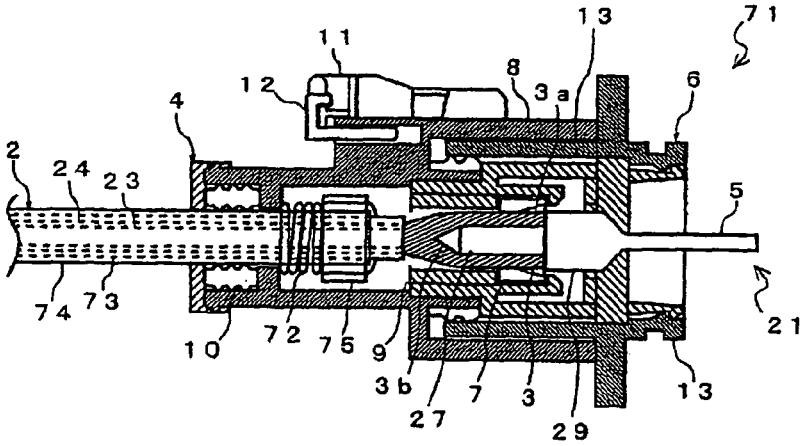

FIGS. 7A to 7C are diagrams showing a connector 71 in the second embodiment according to the invention, in which FIG. 7A is a cross-sectional view thereof before mating, FIG. 7B is a cross-sectional view thereof before fastening, and FIG. 7C is a side view thereof after fastening.

A connector 71 shown in FIG. 7A further comprises a spring (coil spring) 72 as an elastic member which biases (energizes) the female terminal cable 20 forward in the female outer housing 9 in addition to the connector 1 in the first embodiment. The spring 72 comprises a conductive material.

In the second embodiment, a shield layer 73 and a sheath layer 74 are sequentially formed at an outer periphery of the insulating layer 24 in the female terminal cable 20.

In the connector 71, the sheath layer 74 of the female terminal cable 20 provided at a backward of the female terminal 3 is removed to expose the shield layer 73. Then, a ferrule 75 comprising a conductive material is provided around the outer periphery of the female terminal cable 20 that is provided backward with respect to the exposed part of the shield layer 73, such that the ferrule 75 contacts the shield layer 73.

The spring 72 is wound around the cable 2. The spring 72 contacts the ferrule 75 at one end and contacts the female outer housing 8 at another end. In other words, the spring 72 is disposed between the female outer housing 8 and the ferrule 75 to bias the ferrule 75 forward, thereby biasing the female terminal cable 20 forward. The female terminal 3 is held in a predetermined position by a spring force of the spring 72, before mating the female connector 4 and the male connector 6.

In addition, since both the spring 72 and the ferrule 75 comprise the conductive material, the shield layer 73 is electrically connected to the female outer housing 8 via the ferrule 75 and the spring 72. In other words, the spring 72 and the ferrule 75 function as a connecting member to electrically connect the shield layer 73 to the female outer housing 8.

(Mating Operation of the Female Connector 4 and the Male Connector 6)

As shown in FIG. 7B, for mating the female connector 4 and the male connector 6 in the connector 71, the projection 13*a* of the male connector 6 is inserted along the guide groove 8*a*, similarly to the connector 1 of FIGS. 1A and 1B. Simultaneously, the terminal part 27 of the pin terminal 21 is inserted into the female terminal 3, so that a tip end of the pressing part 29 of the pin terminal 21 abut a tip end of the female terminal 3. Thereafter, the lever 11 is rotated to the locked position. As shown in FIG. 7C, the male connector 6 is pulled to a side close to the female terminal 4. The pressing part 29 presses the tip end of the female terminal 3 to push the female terminal cable 20 against the spring 72 to a backward direction with respect to the fastening member 7, thereby sliding the female terminal cable 20. According to this operation, the spring 72 is compressed and the fastening member 7 is subsequently slid forward toward the tip end of the female terminal 3. As a result, the terminal part 27 of the pin terminal 21 is fastened in the female terminal 3.

(Removal of the Male Connector 6 from the Female Connector 4)

For removing the male connector 6 from the female terminal 4, the lever 11 is rotated to the released position. The compressed spring 72 makes the female terminal cable 20 protrude forward with respect to the fastening member 7 as shown in FIG. 7B. As a result, the fastening by the fastening member 7 is automatically released.

In the connector 1 of FIGS. 1A and 1B, for removing the male connector 6 from the female connector 4, it is necessary to release the fastening of male connector 6 to the female connector 4 by pressing the female terminal cable 20 toward the male terminal 5, thereby making the female terminal cable 20 protrude forward with respect to the fastening member 7. On the other hand, in the connector 71 provided with the spring 72 for biasing the female terminal cable 20 forward, the fastening of the male terminal 5 to the female terminal 3 is automatically released by rotating the lever 11 is the released position. Therefore, it is possible to easily remove the male terminal 5 from the female terminal 3.

Further, according to the connector 71, it is possible to remove the male terminal 5 from the female terminal 3 in a state that the fastening is released. Therefore, even if the pressing force of the fastener member 7 is increased, it is possible to suppress the wear of the contact portion due toe the removal of the male terminal 5 from the female terminal 3.

Other Embodiments

In the first and second embodiments, the case of using the female terminal cable 20 as shown in FIGS. 2A and 2B is explained. The invention however is not limited thereto.

Figure 8:
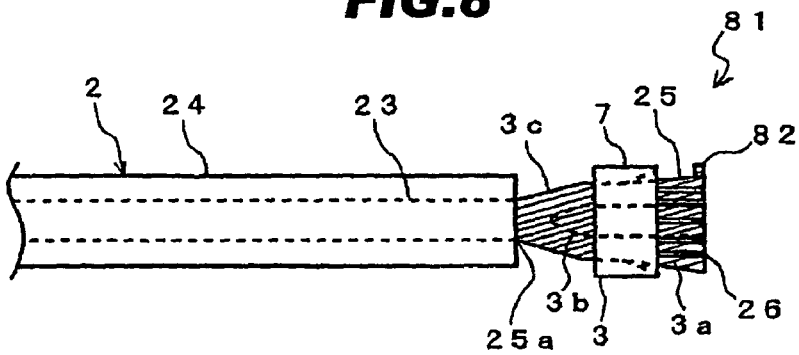
FIG. 8 is a front view showing a female terminal cable in a variation to be used in the connector in the first and second embodiments.

FIG. 8 is a front view showing a female terminal cable 81 in a variation to be used in the connector 1, 71 in the first and second embodiments. As shown in FIG. 8, a female terminal cable 81 may be used in place of the female terminal cable 20. The female terminal cable 81 is provided with a stopper 82 at the tip end of the female terminal 3 for preventing the fastener member 7 from being removed.

Figure 9:
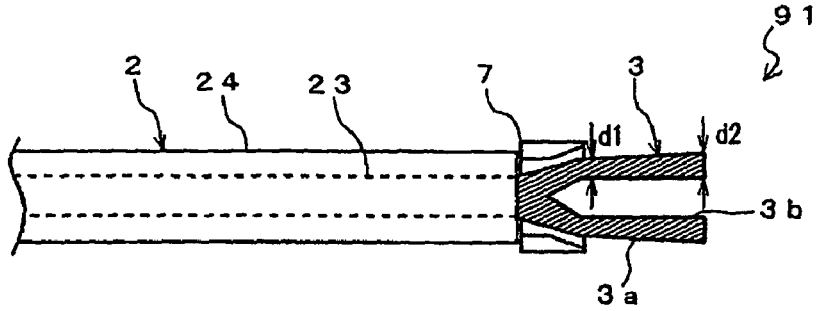
FIG. 9 is a front view showing a female terminal cable in another variation to be used in the connector in the first and second embodiments.

FIG. 9 is a front view showing a female terminal cable 91 in another variation to be used in the connector 1, 71 in the first and second embodiments. As shown in FIG. 9, a female terminal cable 91 may be used in place of the female terminal cable 20. In the female terminal cable 91, a thickness of the stranded conductor 23 in the cylindrical portion 3*a* of the female terminal 3 is widened toward the end part of the cylindrical portion 3*a* to provide a tapered shape (a thickness d2 of the end part of the cylindrical portion 3*a* is greater than a thickness d1 of the cylindrical portion 3*a* on a side of a base 3*c* in the tapered shape).

Further, in place of using the female terminal cable 20, a cylindrical female terminal may be installed to the stranded conductor 23 at the end part of the cable 2, and the fastening member 7 may be slidably provided at the outer periphery of the female terminal.

In the first and second embodiments, the case of using the terminal pin 21 as the male terminal 5 is explained. The invention however is not limited thereto. For example, a male terminal cable 100 as shown in FIGS. 10A and 10B may be used.

Figure 10A:
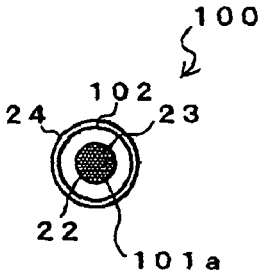
Figure 10B:
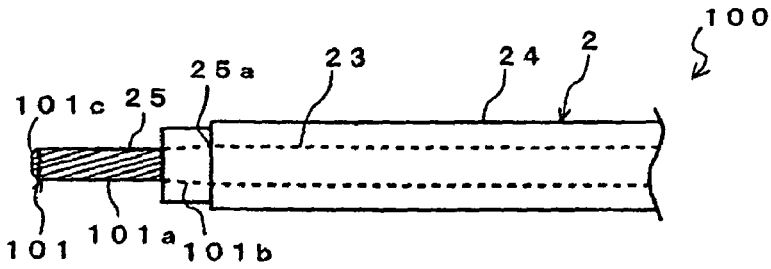

FIGS. 10A and 10B are diagrams showing a male terminal cable 100 used in the connectors in the first and second embodiments, in which FIG. 10A is a side view thereof, and FIG. 10B is a front view thereof.

The male terminal cable 100 comprises a cable 2 including a stranded conductor 23 comprising twisted plural wire conductors 22, and an insulating layer 24 formed around the outer periphery of the stranded conductor 23, and a male terminal 101 formed by molding the stranded conductor 23 at an end of the cable 2. Although the cable 2 of the male terminal cable 100 using the same as that of the female terminal cable 20 is explained here, the cable 2 may be different therefrom in dimensions.

The male terminal 101 is formed with a protruding portion 25 formed by causing the stranded conductor 23 to protrude from the insulating layer 24 at the end of the cable 2, and diametrically compressing the end of the protruding portion 25. The length of the stranded conductor 23 protruding from the end of the cable 2 (the length of the protruding portion 25) is 15 to 20 mm, for example.

More concretely, the male terminal 101 comprises a terminal portion 101*a* at a diametrically compressed the end of the protruding portion 25, and a tapered base 101*b* between a base end 25*a* of the protruding portion 25 at the boundary between the protruding portion 25 and the insulating layer 24, and the terminal portion 101*a*. The tapered base 101*b* is diametrically and gradually compressed from the base end 25*a*. Also at the end of the terminal portion 101*a* of the male terminal 101 is formed a tapered terminal end 101*c*, which is diametrically compressed toward the end of the male terminal 101, to facilitate the insertion of the male terminal 101 into the female terminal 3.

A ring 102 is provided as a pressing part around an outer periphery of the base 101*b* of the male terminal 101. The ring 102 may comprise copper or a copper alloy when the stranded conductor 23 comprises copper or a copper alloy, and the ring 102 may comprise aluminum or an aluminum alloy when the stranded conductor 23 comprises aluminum or an aluminum alloy. Namely, the material of the ring 102 may be selected in accordance with the material of the stranded conductor 23.

When this male terminal cable 100 is used, an arbitrary supporting member for supporting the male terminal cable 100 may be formed in the male inner housing 14, and the male terminal cable 100 may be secured in the male connector 6 via the male inner housing 14.

Although the invention has been described, the invention according to claims is not to be limited by the above-mentioned embodiments and examples. Further, please note that not all combinations of the features described in the embodiments and the examples are not necessary to solve the problem of the invention.

What is claimed is:

1. A connector, comprising:

a female connector for accommodating a cylindrical and deformable female terminal provided at an end of a cable;

a male connector for accommodating a male terminal configured to be inserted into the female terminal;

a fastening member provided slidably around an outer periphery of the female terminal, and configured to tighten the female terminal to fasten the male terminal when inserted into the female terminal; and a slide mechanism for sliding the fastening member, which is provided in the female connector, wherein the slide mechanism comprises a female inner housing for securing the fastening member in the female connector and a supporting member for slidably supporting the cable with respect to the fastening member, the male terminal comprises a pressing part at a base part of the male terminal, and the pressing part is configured to abut and press a tip end of the female terminal to push the cable to slide backward with respect to the fastening member, to tighten the female terminal by the fastening member to fasten the male terminal when the male terminal is inserted into the female terminal.

2. The connector according to claim 1, wherein the slide mechanism further comprises an elastic member which biases the cable forward, and is configured to make the cable protrude forward with respect to the fastening member, to release fastening by the fastening member.

3. The connector according to claim 2, wherein the elastic member biases the cable forward and makes the cable protrude forward with respect to the fastening member, to release fastening by the fastening member, when the male terminal is detached from the female terminal.

4. The connector according to claim 1, wherein the cable comprises a stranded conductor comprising twisted plural wire conductors and an insulating layer formed around an outer periphery of the stranded conductor, and the female terminal comprises a protruding portion formed by protruding the stranded conductor from the insulating layer at an end of the cable, the female terminal being formed in a cylindrical shape by widening a center of an end of the protruding portion to make the protruding portion hollow.

5. The connector according to claim 4, wherein the female terminal comprises a cylindrical portion cylindrically molded by diametrically widening the stranded conductor at the end of the protruding portion, and a tapered base which connects the cylindrical portion and a base part of the protruding portion, the tapered base being diametrically and gradually widened from the base part, wherein the cylindrical portion is formed with plural slits in its axial direction, which circumferentially split the cylindrical portion.

6. The connector according to claim 5, wherein the cylindrical portion of the female terminal is formed to be widened toward its end.

* * * * *